United States Patent [19]

Sawa et al.

[11] Patent Number: 4,726,170

[45] Date of Patent: Feb. 23, 1988

[54] AUTOMATIC FILLING AND PACKAGING SYSTEM

[75] Inventors: Yuji Sawa; Hiroomi Kanou, both of Tokyo, Japan

[73] Assignee: Kureha Chemical Industry Co., Ltd., Tokyo, Japan

[21] Appl. No.: 884,166

[22] Filed: Jul. 10, 1986

[30] Foreign Application Priority Data

| | | | |
|---|---|---|---|
| Jul. 11, 1985 | [JP] | Japan | 60-151407 |
| Aug. 30, 1985 | [JP] | Japan | 60-131473[U] |
| Aug. 30, 1985 | [JP] | Japan | 60-131474[U] |
| Aug. 30, 1985 | [JP] | Japan | 60-131475[U] |

[51] Int. Cl.[4] ..... B65B 43/26

[52] U.S. Cl. ..... 53/570; 53/386; 53/468

[58] Field of Search ..... 53/459, 468, 469, 479, 53/492, 556, 570, 571, 386

[56] References Cited

U.S. PATENT DOCUMENTS

| | | | |
|---|---|---|---|
| 4,174,599 | 11/1979 | Callet et al. | 53/570 |
| 4,301,842 | 11/1981 | Kuckhermann | 53/386 |
| 4,353,198 | 10/1982 | Koppe | 53/570 |
| 4,581,874 | 4/1986 | Rechtsteiner et al. | 53/433 |
| 4,617,785 | 10/1986 | Chikatani et al. | 53/570 |

FOREIGN PATENT DOCUMENTS

| | | | |
|---|---|---|---|
| 790240 | 2/1958 | United Kingdom | 53/386 |
| 1375910 | of 1974 | United Kingdom | 53/386 |
| 1561780 | 3/1980 | United Kingdom | 53/556 |

*Primary Examiner*—Robert L. Spruill
*Assistant Examiner*—Donald R. Studebaker
*Attorney, Agent, or Firm*—Rosen, Dainow & Jacobs

[57] ABSTRACT

An automatic bag filling and packaging system includes a filling apparatus for filling a bag with a material through a bag mouth, and a bag supply apparatus for supplying the filling apparatus with individual bags. The bag supply apparatus has separating means for separating a chain of interconnected bags, each of which is sealed along its entire periphery, into individual bags at perforations between adjacent bags. The filling apparatus includes unsealing means and mouth widening means. The unsealing means includes a cutting member which, while a bag sealed along its entire periphery is being held, is operable to cut off one side edge of the bag to provide the bag with an unsealed mouth. To prevent a material introduced into a bag from adhering to the mouth widening means during a filling operation, the widening means includes a suction device for opening the bag mouth by attracting the outer surface of the bag near the cut edge, two widening members thrust into the bag from the mouth and then separated from each other to widen the mouth, and a suction device for attracting the outer surface of the bag to maintain the mouth in the widened state so that the widening members can be withdrawn from the bag prior to filling. Also provided is positioning means for positioning each bag in X and Y directions before the bag is received by the filling apparatus.

2 Claims, 10 Drawing Figures

AUTOMATIC FILLING AND PACKAGING SYSTEM

BACKGROUND OF THE INVENTION

This invention relates to an automatic filling and packaging system for filling bags with a material. More particularly, the invention relates to an automatic filling and packaging system of the type having a filling apparatus comprising bag receiving means, bag mouth widening means, filling means, deairing means and temporary sealing means, permanent sealing means and carry-out means arranged in the order mentioned at respective positions to which bags are fed intermittently. The invention further relates to means for positioning, at a prescribed location, each bag supplied to the bag receiving means, means for cutting open one of the four sealed side edges of each bag to provide the bag with a mouth prior to filling, and the means for widening the mouth in order to fill the bag.

An automatic filling and packaging system of the type described is widely used to fill bags with various materials in order to package the materials. Conventionally, the system is designed to handle bags having one side edge already unsealed, this unsealed or open edge serving as a mouth. Recently, sterilized bags have come into use which are completely sealed along their entire periphery at the time of manufacture in order to provide a perfectly sterilized condition inside the bag. Immediately prior to filling the bag, one side edge thereof is cut off to provide the bag with a mouth in preparation for the subsequent filling operation. Since the conventional filling and packaging system mentioned above is not capable of handling such sterilized bags sealed at all four sides, the bags are cut open as described above by a separately provided device.

The conventional filling and packaging system has another shortcoming involving the method through which a bag, cut open as mentioned above, is filled with material. Specifically, the bag mouth, which tends to close due to adhesion between the opposing bag sheets, is widened slightly by appropriate means such as suction devices, a pair of widening members are inserted into the bag through the opened mouth, and the widening members are spread apart to open the mouth widely enough for filling. While held in this state, the bag is brought to the filling station where it is filled with material. The interior of the bag is then deaired and the mouth is sealed to end the filling and packaging process. However, since the mouth of the bag must be spread wide enough to allow filling, the widening members are left inserted in the bag while the bag is being filled. Consequently, depending upon the type of material with which the bag is filled, the material attaches itself to the mouth of the bag owing to the presence of the widening members. This not only destroys the sterilized condition but also results in a poor seal and detracts from the external appearance of the bagged item.

Problems are also encountered in the various means constituting the filling apparatus of the automatic filling and packaging system.

The first problem involves a bag supply device for supplying the filling apparatus with individual bags. In order to fill bags in a regular condition at all times, it is necessary that the bag supply device supply the bag receiving means of the system with bags at a prescribed position. To accomplish this, the conventional bag supply device has bag positioning means.

In a known conventional arrangement, the bag positioning means includes e.g. a fixed receiving plate to which a bag is fed and feed rollers for forcibly feeding the bag in one or two directions on the receiving plate to abut the bag against a positioning member provided at one edge of the receiving plate, whereby the bag is positioned. However, since the bag is forcibly fed by the feed rollers, even a slight positional deviation will cause the bag to wrinkle, the bag tends to fed in a skewed attitude if it is in such an attitude at the start of feeding, and the bag is not correctly positioned if it is thrust against the positioning member too strongly. Moreover, since the extent and manifestation of these problems differ depending upon the type and size of the bags, dealing with them is difficult.

Further, as mentioned above, the conventional filling and packaging system does not posssess means for cutting off one edge of a sterilized bag during the filling process in order to unseal the bag. Since the conventional system therefore is not capable of dealing with these sterilized bags, the bag is cut open by a separately installed apparatus. This means that after being cut open, a bag may remain in stock for an extended period of time before being filled, or that the bag may be carried through a poor environment in order to be brought to the filling and packaging system. In either case, bacteria will have an opportunity to attach to the bag, thus rendering meaningless the use of sterilized bags in the first place.

A problem is also encountered in the means for spreading open the mouth of an unsealed bag to permit filling. Specifically, it is known in the art to adopt an arrangement using suction devices as the bag mouth widening means. In the known arrangement, two suction devices are disposed to oppose each other an both sides of the bag mouth, the devices are moved toward each other to attract both surfaces of the bag and are then separated from each to widen the bag mouth. However, if the opposing sheets of the bag defining the bag mouth happen to be stuck together, or, in particular, if the bag is made of a very thin material such as a polyethylene film, opening the mouth can be very difficult.

SUMMARY OF THE INVENTION

Accordingly, an object of the present invention is to provide an automatic filling and packaging system capable of handling bags sealed along their entire periphery, particularly sterilized bags, while at the same time avoiding contamination of the bag mouth when the bag is filled.

Another object of the present invention is to provide bag positioning means capable of positioning any kind of bag accurately in two directions in order to supply bag receiving means with bags in a correct position.

Still another object of the present invention is to provide means capable of cutting open a bag, which is sealed on all four sides edges, in a process performed by an automatic filling system arranged in an aseptic chamber.

A further object of the present invention is to provide bag mouth widening means capable of readily opening a bag mouth irrespective of the bag material or condition.

An automatic bag filling and packaging system according to the present invention comprises a filling apparatus for filling a bag with a material through a bag mouth to package the material within the bag, and a bag supply apparatus for supplying the filling apparatus with bags one at a time.

The bag supply apparatus has separating means for separating a chain of bags, each of which is sealed along its entire periphery and connected at perforations to an adjoining bag, into individual bags at the perforations. Though there is no particular limitation upon the mechanism of the separating means, the latter may be a feed device comprising a rapidly rotated first feed roller disposed ahead of the chain of bags pulled from a roll thereof, and a second feed roller rotated slower than the first feed roller and disposed rearwardly of the chain of bags, the two feed rollers utilizing the difference in their rotational speeds to separate one bag at a time from the chain.

The filling apparatus comprises unsealing means, mouth widening means, filling means, sealing means and carry-out means arranged in the order mentioned at respective positions to which bags are fed intermittently, starting at bag receiving means located adjacent the separating means for receiving the bags one at a time. Each bag is held by the bag receiving means in, say, a suspended state. While the bag is so suspended, it is moved to each of the above means in intermittent fashion, each of these means being adapted to operate when the bag arrives at its location.

The unsealing means includes a cutting member which, while a bag sealed along its entire periphery is being held, is operable to cut off one side edge of the bag to provide the bag with an unsealed mouth.

The mouth widening means, filling means, sealing means and carry-out means may be of the same construction as in the prior art. However, to prevent a material introduced into a bag from adhering to the mouth widening members of the widening means during a filling operation, the widening means in a preferred embodiment of the invention comprises a mouth opening suction device for opening the bag mouth by attracting the outer surface of the bag near the cut edge, a pair of mouth widening members for being thrust into the bag from the mouth and then separated from each other to widen the mouth, and an opened-mouth retaining suction device for attracting the outer surface of the bag to maintain the mouth in the widened state, thereby allowing the pair widening members to be withdrawn from the inside of the bag prior to filling.

Thus, according to the invention, a chain of bags sealed along their entire periphery and interconnected at perforations are pulled from a roll. The chain of bags is separated into individual bags one bag at a time by utilizing the speed differential between the two feed rollers in the separating means of the supply apparatus, and each separated bag is delivered to the filling apparatus.

At the filling apparatus, the bag is held by the bag receiving means, in which state the bag is carried to the unsealing means, which proceeds to cut off one side edge of the bag by the cutting member to provide the bag with a mouth. Next, the bag has its mouth widened by the mouth widening means and is filled with the material to be packaged. The mouth of the bag is then sealed by the sealing means, after which the filled and sealed bag is carried out as a finished product by the carry-out means.

In the preferred embodiment of the mouth widening means mentioned above, the mouth opening suction device opens the bag mouth, whose sides may be stuck together, at the beginning of the opening process, the two widening members are inserted into the mouth and then moved apart to widen the mouth, then the retaining suction device is actuated to maintain the mouth in the widened state and the widening members are withdrawn, after which the opened bag is carried to the filling means. Thus, the material introduced into the bag will not attach itself to the widening members.

According to the present invention in another aspect thereof, bag positioning means is provided for positioning a bag in X and Y directions in order that the bag may be supplied to an automatic filling and packaging apparatus at a prescribed position, bags being fed into the positioning means one at a time in the X direction by a pair of feed rollers having respective axes aligned in the Y direction. The positioning means comprises a receiving plate having one edge thereof facing an exit side of the feed rollers, the receiving plate being tiltable about this one edge from a horizontal position to a downwardly inclined position through a set angle, an X-direction positioning member attached to the receiving plate at a position set downstream in the direction of feed to position the bag in the X direction, a Y-direction positioning member arranged at a position set in the Y direction to position the bag in the Y direction, X-direction feed means for advancing the bag on the receiving plate in the X direction when the receiving plate is in the horizontal position, and Y-direction feed means which acts solely upon a lower surface of the bag on the receiving plate for moving the bag in the Y direction when the receiving plate is in the tilted position.

Though various constructions are conceivable for the X- and Y-direction feed means, in a preferred embodiment the X-direction feed means comprises X-direction feed rollers which contact the upper surface of the receiving plate when the receiving plate is in the horizontal position, and the Y-direction feed means comprises Y-direction rollers rotatable in the Y direction, these rollers projecting from above the upper surface of the receiving plate through respective windows in the receiving plate when the plate is tilted to its inclined position.

In the positioning operation of the above-described described bag positioning means, one bag is supplied to the positioning means by the pair of feed rollers. At this time the receiving plate is in the horizontal position and the X-direction feed means is actuated to feed the bag until its leading edge arrives in the vicinity of the X-direction positioning member of the receiving plate. Next, the receiving plate is tilted to incline the plate downwardly with respect to the X direction. At this time the X-direction feed means is no longer operable, so that the bag is in a free state. As a result, the bag slides downwardly along the receiving plate under the force of gravity and its leading edge reaches the position of the X-direction positioning member. At the same time, the Y-direction feed means is actuated, as this accompanies the tilting of the receiving plate. Since the Y-direction feed means acts solely upon the lower surface of the bag, the bag is not subjected to an excessive force. As a result, while its position in the X direction is maintained, the bag is transferred in the Y direction until one side edge of the bag arrives at the position of the Y-direction positioning member. The bag thus is brought to a position set in both the X and Y directions.

According to the present invention in another aspect thereof, bag unsealing means is provided for cutting off one edge of a bag having four sealed edges in order to provide the bag with a mouth. The unsealing means comprises a pair of bag clampers freely movable toward and away from each other for clamping the one edge of the bag from both sides thereof at two positions where the bag clampers are parallel to the bag, and a blade for cutting into the bag between the two positions, each of the bag clampers having irregularly shaped portions for locally deforming the bag when the bag is clamped.

One of the two bag clampers is provided with vacuum holes at positions corresponding to the clamped edge of the bag. These holes are adapted to produce vacuum pressure to hold the edge of the bag that has been cut off. This prevents the resulting cut strip from being scattered and makes it possible for the cut strips from a multiplicity of bags to be collected at one location.

According to this aspect of the invention, one side edge of a bag having four sealed sides is cut off to provide the bag with a mouth in the following manner: First, in the automatic filling and packaging process, the bag sealed at four sides is held by means such as a chuck, in which state the two bag clampers are moved toward each other from spaced-apart positions. Next, the two bag clampers are brought together through the intermediary of the one edge of the bag to clamp this edge at two positions parallel thereto. Thus, the bag is held rigidly at the two positions and, at the same, the bag is locally deformed by the irregularly shaped portions of the bag clampers. Next, the blade is thrust between the two positions to cut off the clamped edge of the bag and is then withdrawn. The bag thus cut open to be provided with a mouth is freed by moving the two bag clampers away from each other, after which the bag is carried to the next process.

If one of the bag clampers is provided with the vacuum holes mentioned above, it can be arranged so that the vacuum pressure produced will hold the strip cut from the bag until the two clampers are separated from each other, with the vacuum pressure being terminated upon passage of a prescribed period of time to drop the strip so that the strip may be collected at a central location.

In a further aspect of the invention, there is provided mouth widening means for widening the mouth of the bag unsealed as described above in order that the bag may be filled. The mouth widening means comprises first and second opening suction devices arranged on respective side surfaces of the bag for opening the mouth of the bag by attracting the side surfaces at the mouth portion and then moving apart from each other. The first opening suction device has suction points at least at two locations, and the second opening suction device is situated between the at least two suction points of the first opening suction device. The first and second opening suction devices are moved toward each other, with the bag interposed therebetween, to respective positions wher the bag is grasped between them.

Since the two suction devices form corrugations or wrinkles in the bag when attracting the bag, air is permitted to flow into the bag from its mouth to facilitate bag opening. More specifically, suction points of the second suction device are situated between the at least two suction points of the first suction device, and the two devices are moved toward each other from both sides of the bag up to positions where they grasp the bag between them, thus partially corrugating the bag mouth. Air then flows into the bag mouth, after which the two suction devices are separated from each other to draw open the mouth of the bag. In this way the bag mouth is opened with ease.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

The automatic filling and packaging system embodying the present invention will now be described with reference to the drawings.

Figure 1:
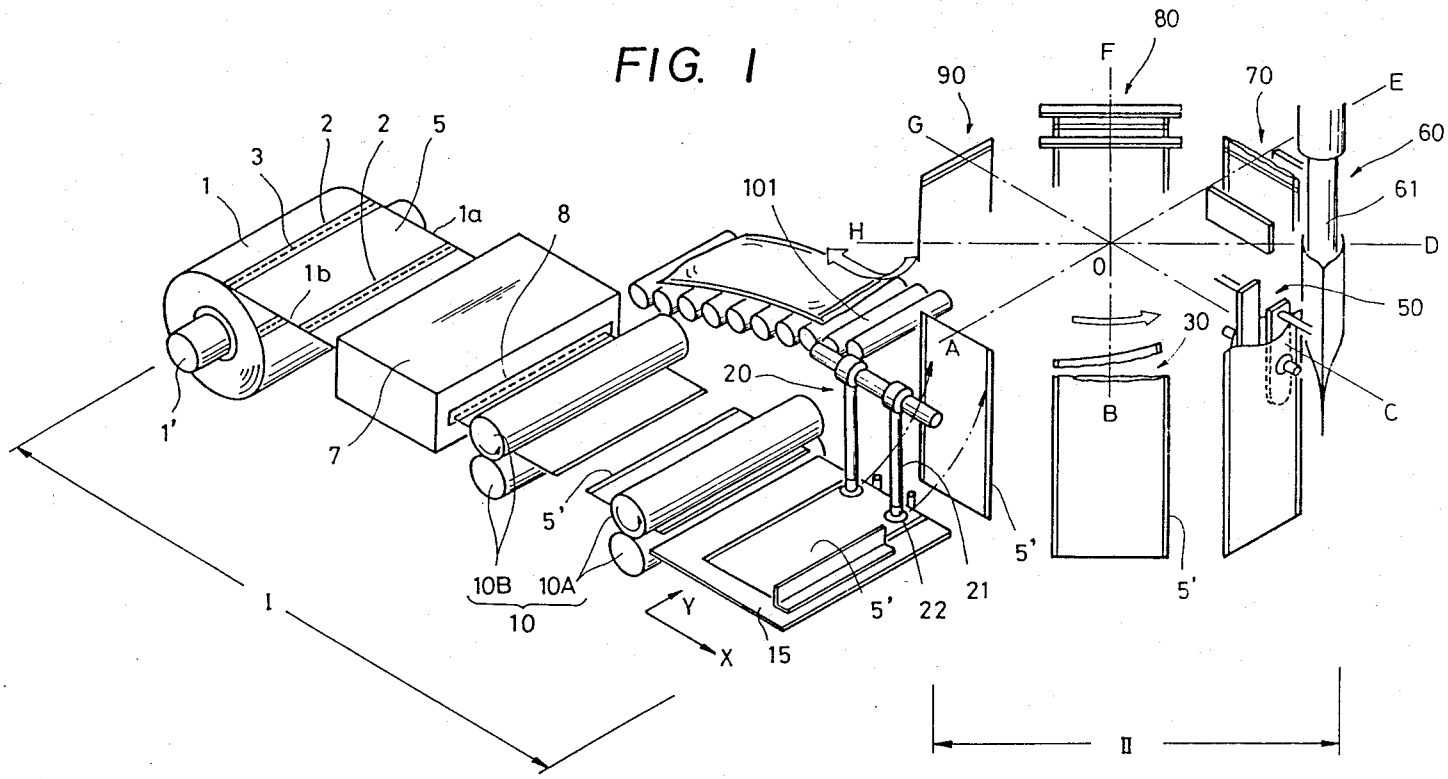
FIG. 1 is a schematic perspective view illustrating an embodiment of an automatic filling and packaging system according to the present invention.

FIG. 1 is a perspective view of the system, which comprises a bag supply apparatus I and a filling apparatus II.

The bag supply apparatus I includes a roll 1 of bagging stock axially supported on a shaft 1', an ultraviolet sterilizing unit 7, separating means 10, and bag positioning means 15, these components being disposed in the order mentioned along a direction X in which the bagging stock is pulled from the roll 1.

The roll 1 consists of a material molded into a tubular film-like configuration in a sterilized state, the material then being flattened and wound up into a roll. Accordingly, the rolled material has longitudinal side edges 1*a* and 1*b* that are in a folded and closed state. The rolled material is subjected to a sealing treatment to be provided with laterally extending sealed portions 2 at fixed intervals longitudinally thereof. Perforations 3 are provided along the center of each sealed portion 2. A bag 5 is defined by the two closed longitudinal side edges 1*a*, 1*b* and two mutually adjacent ones of the sealed portions 2. The bag 5 is connected to its neighbors by the perforations 3. Thus, a chain of interconnected bags 5 is formed, each bag 5 being sealed along its entire periphery, that is, at each of its four edges.

The ultraviolet sterilizing unit 7 is arranged immediately adjacent the roll 1 downstream thereof to receive the interconnected bags 5 pulled off the roll 1 in the X direction. When the bags pass through the interior of the sterilizing unit 7, each is sterilized by having its outer surface irradiated with ultraviolet rays. To this end, the sterilizing unit 7 has an opening 8 on its inlet and outlet sides and accommodates sterilizing lamps (not shown) for emitting ultraviolet radiation.

Figure 2:
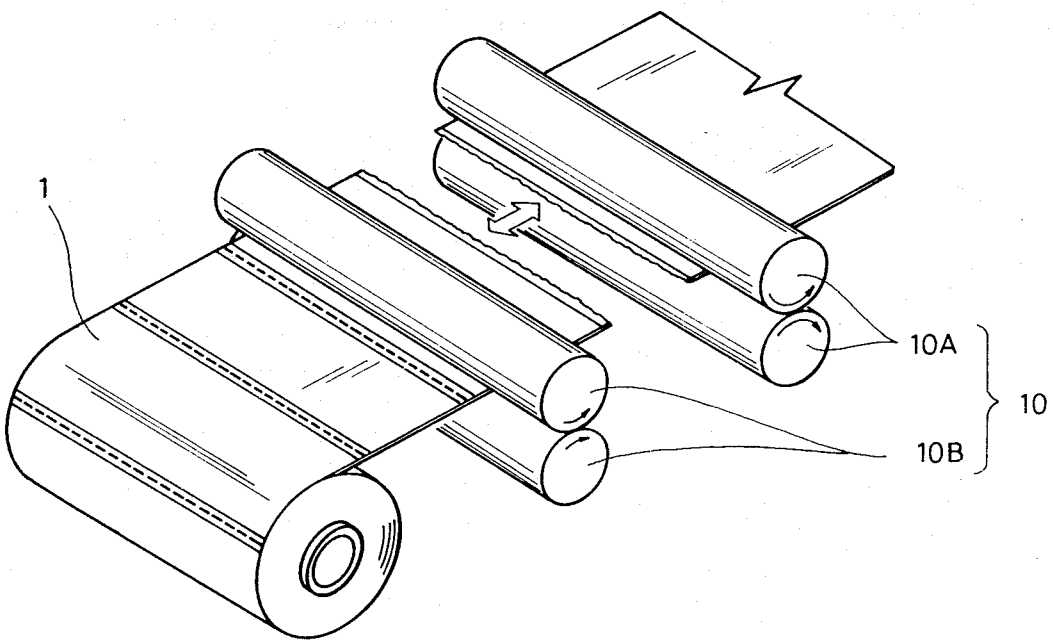
FIG. 2. is a schematic perspective view illustrating separating means included in the system of FIG. 1.

Arranged at a position near the outlet of the sterilizing unit 7 is separating means 10 comprising a pair of front feed rollers 10A and a pair of rear feed rollers 10B. Each of the pairs of feed rollers 10A, 10B comprises an upper pinch roller and a lower pinch roller. The front feed rollers 10A are rotated somewhat faster than the rear feed rollers 10B, thereby producing a speed differential which acts to separate a single bag 5' from the chain of interconnected bags at the perforations 3. This is illustrated more clearly in FIG. 2.

Figure 3A:
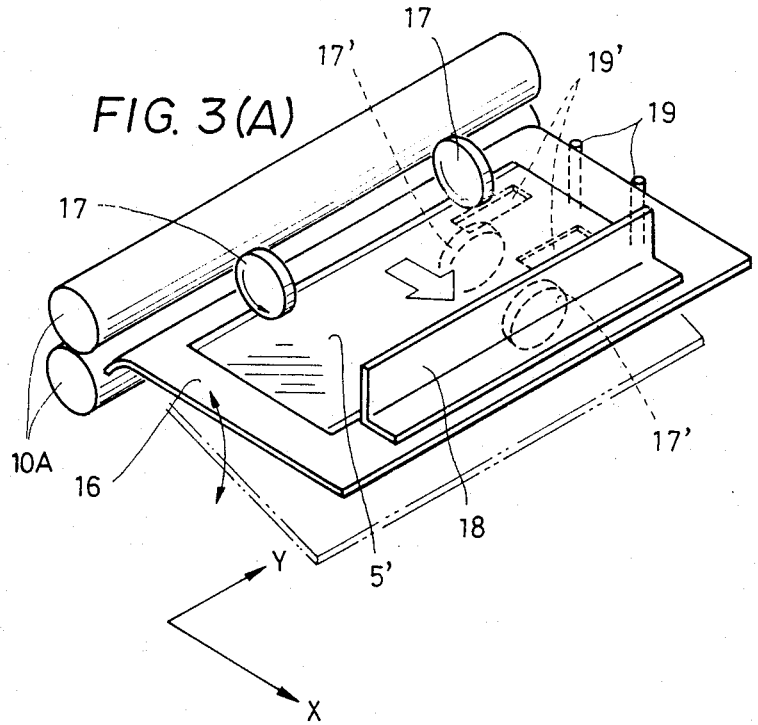
FIG. 3 schematically illustrates bag positioning means included in the system of FIG. 1, in which (A) is a perspective view of the positioning means showing a receiving plate in a horizontal position, and (B) is a perspective view of the positioning means showing the receiving plate in a tilted position.
Figure 3B:
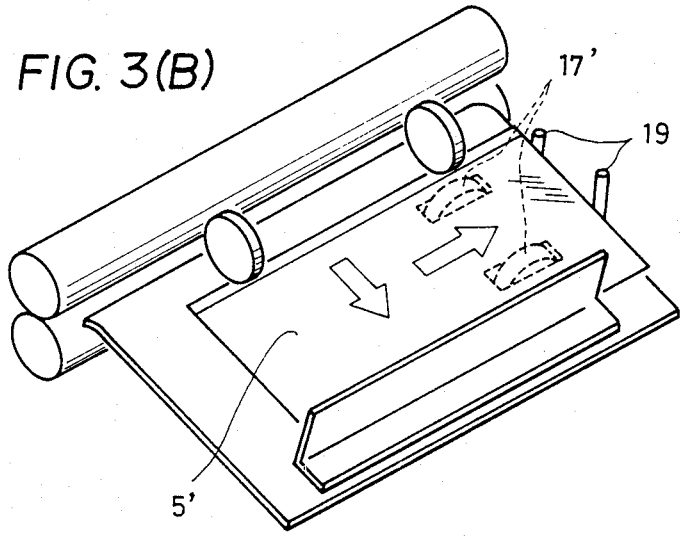

Bag positioning means 15 is provided on the exit side of the front feed rollers 10A in close proximity thereto. As shown in FIG. 3, the bag positioning means 15 has a receiving plate 16 one longitudinal edge of which faces the exit of the front feed rollers 10A, the plate 16 being tiltable between upper and lower positions about this edge. Provided at this edge of the receiving plate 16 are two feed rollers 17 which contact the plate 16 when the plate 16 is in its upper or horizontal position. Attached to the receiving plate 16 at the opposite longitudinal edge portion is an X-direction positioning member 18 for regulating the forward position of the bag 5' in the X direction. A Y-direction positioning member 19 for regulating the position of the bag 5' in the Y direction is provided at a position near one transverse side edge of the receiving plate 16 in the Y direction. The receiving plate 16 is formed to include two windows 19'. Provided directly below the windows 19' are two rollers 17' which, when the receiving plate 16 is in its horizontal position, underlie the plane of the windows 19, as shown in (A) of FIG. 3, but which protrude slightly from the windows 17' when the receiving plate 16 is in its lowered or tilted position, as depicted in (B) of FIG. 3.

Returning to FIG. 1, the filling apparatus II includes a rotary section (not shown) adapted to be rotated intermittently about a center O, and bag receiving means 20, unsealing means 30 (see FIG. 4), mouth widening means 50, filling means 60, deairing and temporary sealing means 70, permanent sealing means 80 and carry-out means 90, which are arranged at positions A through G, respectively, located along the circumference of the rotary section. A position H is vacant.

The rotary section is similar to that in a conventional rotary-type filling and packaging system and the associated mechanism is not shown. However, suffice it to say that the rotary section includes a bag holding mechanism having suction devices for holding open the mouth of a bag at each of the eight positions along the circumference of the rotary section, and that the rotary section is adapted to rotate intermittently while the bag is held with its mouth facing upward at each of the positions A through G.

The bag receiving means 20 is arranged at position A. As in the prior art, the bag receiving means 20 includes an arm 21 at a position in the Y direction of the bag positioning means 15. The arm 21, which has a suction device 22 at one end, is capable of being swung up and down about its other end.

Figure 4:
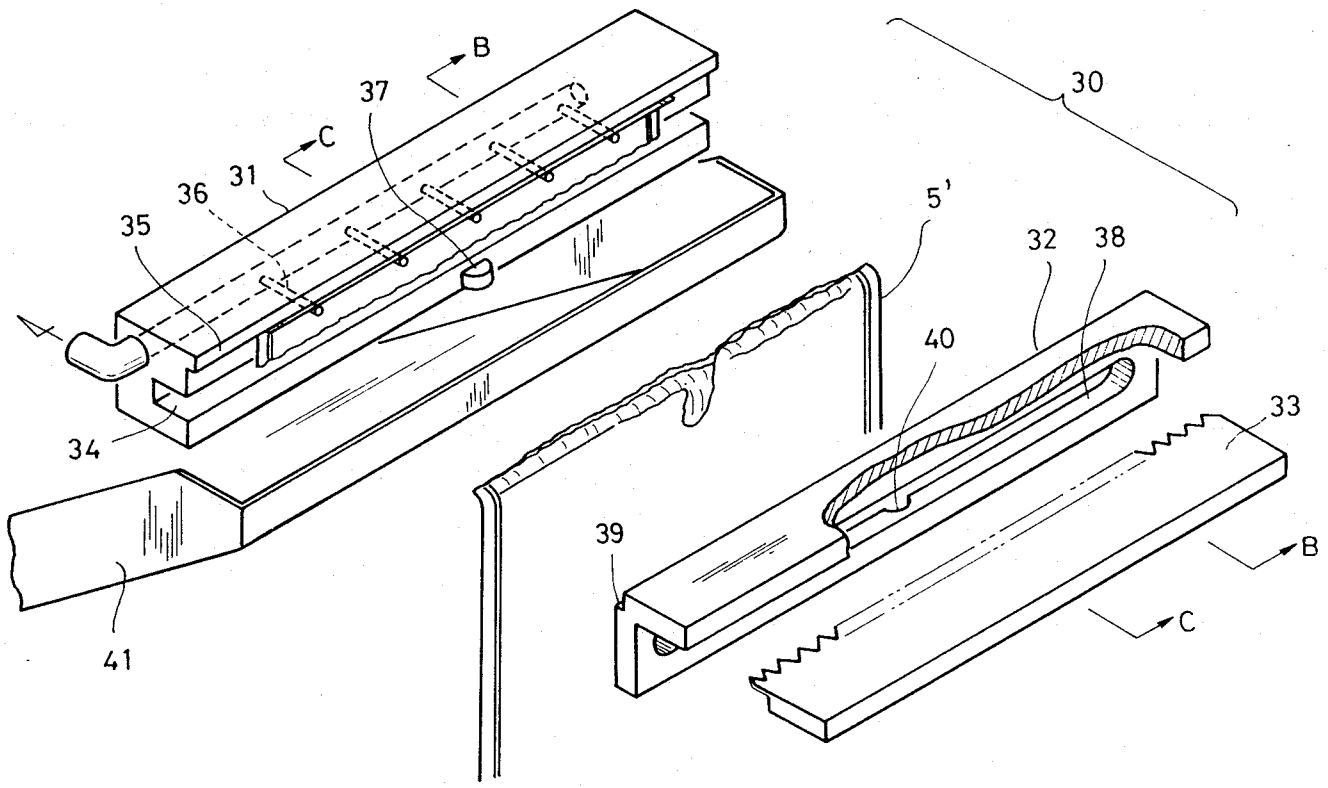
FIG. 4 schematically illustrates unsealing means included in the system of FIG. 1, in which (A) is a perspective view, (B) is a sectional view taken along line B—B of FIG. 4(A), and (C) is a sectional view taken along line C—C of FIG. 4(A)
Figure 4:
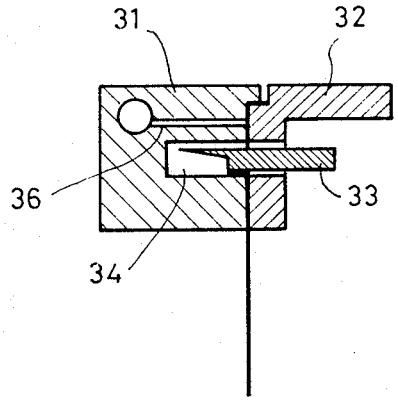
Figure 4:
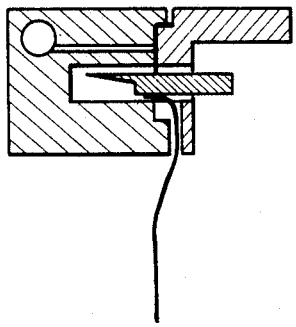

The unsealing means 30 is arranged at the position B and, as illustrated in detail in (A) of FIG. 4, comprises a pair of bag clampers 31, 32 and a blade 33.

The bag clamper 31 is disposed at a position on the outer side of the path of travel of bag 5' and is adapted to be reciprocated toward and away from the other bag clamper 32. The bag clamper 31 is open on its outer side and has a longitudinally extending groove 34 to provide clearance for the blade 33. The outer side of the bag clamper 31 is formed at its upper portion to include a longitudinally extending step portion 35 projecting toward the other bag clamper 32. The upper portion of the groove 34 at the outer side of the clamper 31 is provided with a plurality of vacuum holes 36 open to the outer side. The lower portion of the groove 34 on the outer side of the clamper 31 is formed to include a semicircular projection 37 at a central position in the longitudinal direction.

The other bag clamper 32 is situated inside the path of travel of bag 5' and is adapted to be reciprocated toward and away from the bag clamper 31. A slot 38 extending over substantially the entire length of the groove 34 in bag clamper 31 is provided on the inner side of the bag clamper 32. The upper portion of bag clamper 32 is formed to include on its inner side a step-like recess 39 corresponding to the step portion 35. Formed centrally in the lower portion of the bag clamper 31 on its inner side is a recess 40 for receiving the projection 37.

The blade 33 is arranged at a position to the rear of the bag clamper 32 and is capable of being passed through the slot 38 in bag clamper 32 to be thrust into the groove 34 of bag clamper 31. A sawtoothed cutting edge is formed on the leading edge of the blade 33.

A receptacle 41 is provided at a position below the bag clamper 31 to receive a strip cut off the bag 5'. The strip falls into the receptable 41 and slides downwardly away from the bag clamper.

Figure 5A:
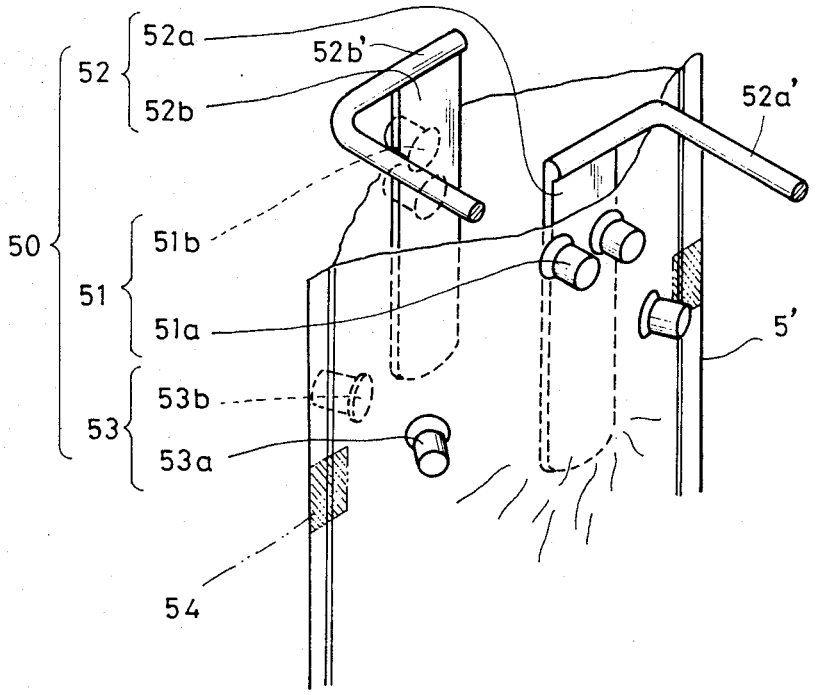
FIG. 5 schematically illustrates mouth widening means included in the system of FIG. 1, in which (A) is a perspective view, (B) is a partial perspective view showing opening suction devices in a state attracting and grasping a bag at a mouth portion thereof, and (C) is a partial longitudinal sectional view of FIG. 5(A).
Figure 5:
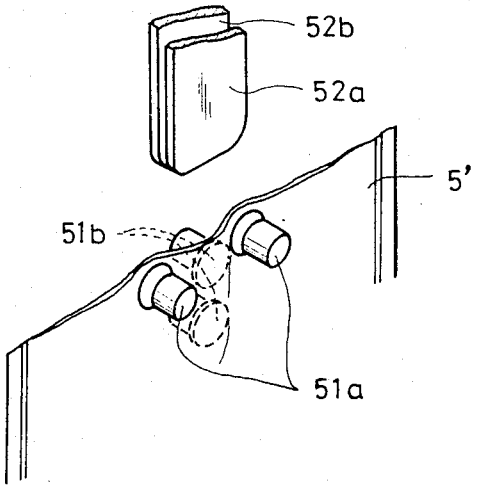
Figure 5:
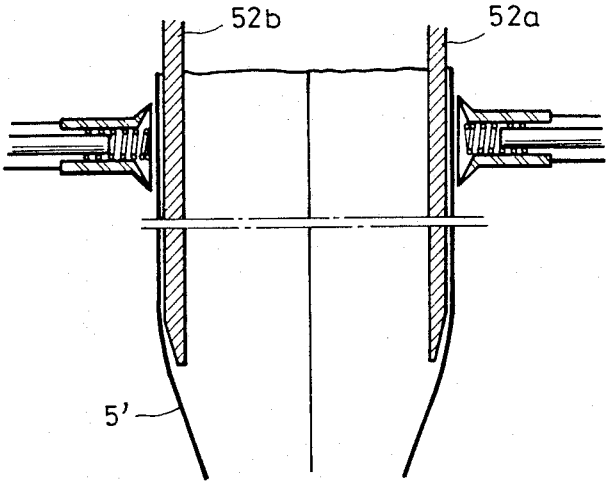

The mouth opening means 50 is provided at position C and, as shown in (A) of FIG. 5, comprises opening suction means 51 and mouth widening means 52.

The opening suction means 51 includes two opening suction devices 51*a* facing one side of the bag 5' and two opening suction devices 51*b* facing the other side of the bag 5' close to the bag mouth at centrally located positions. The two suction devices 51*a* are disposed close together on a line extending laterally of the bag 5', and the two suction devices 51*b* are disposed close together on a line extending longitudinally of the bag. The suction devices 51*a*, 51*b* are arranged at positions where straight lines connecting the two devices 51*a* and straight lines connecting the two devices 51*b* will intersect each other in the plane of the bag. The suction devices 51*a*, 51*b* are capable of being reciprocated at right angles to the plane of the bag. After being moved to positions where they grasp the bag 5' between them and apply suction thereto, as shown in (B) of FIG. 5, the suction devices 51*a*, 51*b* are retracted to positions where the mouth of the bag will be drawn open by suction, as shown in (A) of FIG. 5. A satisfactory retraction distance is such as will allow the bag mouth to be opened far enough to permit insertion of two widening tongues when the widening members are close to each other, as will be described next.

The mouth widening means 52 comprises two widening tongues 52*a*, 52*b* extending downwardly from respective arms 52*a*', 52*b*'. The two tongues 52*a*, 52*b* are movable up and down so as to be capable of being inserted into and withdrawn from the bag from a position overlying the bag mouth. Once inserted into the bag from its mouth, the tongues 52*a*, 52*b* are capable of being moved away from each a predetermined mouth widening distance at right angles to the plane of the bag.

Provided slightly below the bag mouth at a position to the side thereof is suction means 53, supported by a bag holding mechanism, for holding open the mouth of the bag. The suction means 53 comprises a pair of suction devices 53*a* facing one side of the bag, and a pair of suction devices 53*b*, only one of which is shown, facing the other side of the bag, in a manner similar to the opening suction means 51. The suction devices 53*a*, 53*b* are set at positions where they are capable of maintaining the bag mouth in the widely opened state.

The hatched portions shown immediately below the suction devices 53*a*, 53*b* in (A) of FIG. 5 indicate where the bag is clamped by the bag holding mechanism, not shown.

Arranged at the position D in FIG. 1 is the filling means 60 having a nozzle 61 thrust into the mouth of the bag from above to fill the bag with a material. The deairing and temporary sealing means 70 is provided at position E, and the permanent sealing means is provided at the position F. Finally, the carry-out means 90, which includes a conveyor 101, is arranged at the position G.

It should be noted that the means at position D through F may be the same as those in the conventional system, and that these shall not be described in detail. Each of these means is arranged in a clean room.

The operation of the illustrated embodiment will now be described on a step-by-step basis.

(1) First, the chain of interconnected bags in the form of a tubular film is pulled from the roll 1 and fed into the ultraviolet sterilizing unit 7. Since the inner surface of the film is sterilized at the time of molding, only the outer surface of the film need be sterilized by passing the film through the unit 7. Thus, the film that emerges from the unit 7 is sterilized on both its inner and outer surfaces.

(2) Next, the film enters the separating means 10. Here, since the front feed rollers 10A are rotated faster than the rear feed rollers 10B, the film is separated at its perforations 3 owing to the speed differential. The portion separated from the remainder of the chain is the individual bag 5'.

(3) The bag 5' is delivered to the bag positioning means 15. Initially, the receiving plate 16 thereof is in the upper or horizontal position, so that the feed rollers 17 are in contact with the plate 16, as shown in (A) of FIG. 3. Accordingly, the bag is fed forwardly in the X direction by the feed rollers 17. The receiving plate 16 is then tilted downwardly, as shown in (B) of FIG. 3.

(4) When the receiving plate 16 is tilted to the inclined attitude, the bag 5' travels in the X direction owing to the drive rollers 17 and the force of gravity until its leading edge abuts against the X-direction positioning member 18. The bag 5' also is fed in the Y direction by the rollers 17', which project slightly from the windows 19' in the receiving plate 16, until one side edge of the bag abuts against the Y-direction positioning member 19. The bag 5' is thus brought to predetermined positions in the X and Y directions.

(5) Next, at the receiving means 20, the bag positioned as described above is attracted by the suction device 22, after which the arm 21 is swung upwardly in the direction of the arrows shown in FIG. 1 to lift the bag to a position where it is clamped by the bag holding means, not shown. This is followed by intermittently rotating the rotary mechanism, whereby the bag hanging down from the bag holding mechanism is successively carried to and stopped at each of the positions B through G.

(6) When the bag 5' arrives at the unsealing means 30 at position B, the bag clampers 31, 32 are pressed together through the intermediary of the bag 5' to clamp the upper edge of the bag. Vacuum pressure is then produced at the vacuum holes 36 to attract the upper edge of the bag 5'. Next, the blade 33 is actuated to be thrust through the slot 38 in bag clamper 32 and into the groove 34 in bag clamper 31, thereby cutting through the bag 5', as shown in (B) and (C) of FIG. 4. It will be noted that the mouth of the bag is caused to wrinkle by the action of the projection 37 and recess 40 at this time. This allows air to flow into the bag through the wrinkled portion of the mouth so that the mouth opening can be readily widened [see (B) of FIG. 5]. Thereafter, the bag clamper 32 and the blade 33 are retracted to their original positions, at which time the strip cut from the upper edge of the bag is held by the vacuum pressure at the vacuum holes 36 and is not allowed to accompany the retracting bag clamper 32. The vacuum pressure is cut off when the bag clamper 32 and blade 33 been fully retracted. When this has been accomplished, the cut strip, which has been locally deformed by the projecting step portion 35 and recessed step portion 39, readily separates from the bag clamper 31 and drops into the receptacle 41.

The bag thus cut open to be provided with a mouth is carried to the mouth widening means 50 at position C.

(7) At the mouth widening means 50, the mouth of the bag is opened slightly by the opening suction means 51. Specifically, the opening suction devices 51*a*, 51*b* are moved toward each other to positions where they can grasp the bag 5' between them. This causes the mouth of the bag to wrinkle so that air can flow into the bag, as shown at (B) in FIG. 5. The suction devices 51*a*, 51*b* are then moved away from each other to readily draw open the mouth of the bag. Next, the widening tongues 52*a*, 52*b* of the widening means are lowered into the bag mouth and are then parted from each other. The suction devices 53*a*, 53*b* then proceed to attract the bag and hold the mouth in the opened state, as depicted at (C) and (A) in FIG. 5. Thereafter, the widening tongues 52*a*, 52*b* are moved toward each other and are withdrawn by being lifted away from the bag.

(8) The bag whose mouth is thus widened is then carried to the filling means 60 at position D, where the bag is filled with a material.

(9) Next, at the deairing and temporary sealing means 70 at position E, the filled bag 5' is deaired and temporarily sealed to prevent reentry of air. The temporarily sealed bag is then permanently sealed, as by being thermally fused, at the permanent sealing means 80 at position F, thus completely packaging the material in the bag. Finally, the bag is carried to the carry-out means 90 at position G, whereby the bag holding mechanism releases its grip to deposit the bag as a final product on the conveyor 101, which proceeds to convey the bag out of the system.

The automatic filling and packaging system of the present invention has a number of advantages, which will now be set forth.

The system handles an interconnected chain of bags each of which is completely sealed along all four edges. During execution of a series of process steps, one bag is separated from the chain, which is pulled from a roll, and one edge of the bag is cut off to unseal the bag and provide it with a mouth immediately before a filling step. Therefore, the invention raises the efficiency of a filling and packaging operation using interconnected, sealed bags, and simplifies the equipment employed in the operation. Since a bag is not unsealed until just before the filling step, the interior of the bag can be maintained in a fully sterilized state. Even more outstanding results can be obtained if the unsealing means of the invention is employed.

Further, in the mouth widening operation, if the mouth widening means are withdrawn from the interior of the bag immediately before the filling step, the material introduced into the bag will not adhere to the mouth. This assures a bacteria-free state, prevents an improper seal at the mouth and does not detract from the external appearance of the bag.

If the filling and packing system includes the positioning means of the invention, positioning of the bag is achieved in the X direction by utilizing the weight of the bag on the tilted receiving plate, and positioning is also achieved in the Y direction by applying a feeding force solely to the lower surface of the bag. The attitude and position of the bag are correctly set by the X- and Y-direction positioning members. As a result, the bag is filled and formed into a package at the subsequent steps while it is maintained at the correct position and in the correct attitude Filling and packaging may thus proceed without failures.

If the mouth widening means of the invention is employed, the opposing surfaces of the bag can be attracted by the opening suction devices having the suction points at staggered locations. This enables the mouth of the bag to be wrinkled so that air may penetrate the bag to permit easy opening. Accordingly, the mouth of the bag can be opened and widened reliably to permit filling without failures, irrespective of the bag material and condition.

As many apparently widely different embodiments of the present invention can be made without departing from the spirit and scope thereof, it is to be understood that the invention is not limited to the specific embodiments thereof except as defined in the appended claims.

What is claimed is:

1. An automatic filling and packaging system for filling bags interconnected in a continuous chain at perforations where each bag is joined at a longitudinal side edge to a longitudinal side edge of a neighboring bag, each bag being sealed along its entire outer periphery, said system comprising:

a bag supply apparatus for supplying the bags one at a time; and a filling apparatus for filling each bag received from said bag supply apparatus with a material through a mouth possessed by the bag to package the material within the bag;

said filling apparatus comprising bag receiving means, bag unsealing means, bag mouth widening means, filling means, sealing means and carry-out means arranged in the order mentioned at respective positions to which each bag is fed intermittently, said bag supply apparatus comprising separating means for separating the chain of bags into individual bags at the perforations, and positioning means for setting each bag at a predetermined position with respect to the bag receiving means;

said bag unsealing means having means for cutting off one edge of the bag to unseal the bag and provide the bag with the mouth at said edge, said bag mouth widening means including:

a mouth opening suction device for opening the mouth of the bag by attracting an outer surface of the bag near the cut edge;

a pair of mouth widening members for being thrust into the bag from the mouth and then moved away from each other to widen the mouth from the inside, and for being withdrawn from said bag before said bag is filled;

an open-mouth retaining suction device for attracting the outer surface of the bag and maintaining the mouth in the widened state during withdrawal of said pair of widening members from the bag and filling.

2. An automatic filling and packaging system for filling bags interconnected in a continuous chain at perforations where each bag is joined at a longitudinal side edge to a longitudinal side edge of a neighboring bag, each bag being sealed along its entire outer periphery, said system comprising:

a bag supply apparatus for supplying the bags one at a time; and a filling apparatus for filling each bag received from said bag supply apparatus with a material through a mouth possessed by the bag to package the material within the bag;

said filling apparatus comprising bag receiving means, bag unsealing means, bag mouth widening means, filling means, sealing means and carry-out means arranged in the order mentioned at respective positions to which each bag is fed intermittently, said bag supply apparatus comprising separating means for separating the chain of bags into individual bags at the perforations, and positioning means for setting each bag at a predetermined position with respect to the bag receiving means;

said bag unsealing means having means for cutting off one edge of the bag to unseal the bag and provide the bag with the mouth at said edge, said bag mouth widening means including:

a mouth opening suction device for opening the mouth of the bag by attracting an outer surface of the bag near the cut edge;

a pair of mouth widening members for being thrust into the bag form the mouth and then at least one of said members moved away from the other to widen the mouth from the inside, and for being withdrawn from said bag before said bag is filled;

an open-mouth retaining suction device for attracting the outer surface of the bag and maintaining the mouth in the widened state during withdrawal of said pair of widening members from the bag and filling.

* * * * *